US006253424B1

(12) United States Patent
Rainville-Lonn

(10) Patent No.: US 6,253,424 B1
(45) Date of Patent: Jul. 3, 2001

(54) CLOSURE FOR ARTICLE OF APPAREL AND FOR USE BY A PERSON HAVING HANDICAPPED HANDS

(76) Inventor: Francine Rainville-Lonn, 303 Fleet Dr., Beaconsfield, Quebec (CA), H9W 5X8

( * ) Notice: Subject to any disclaimer, the term of this patent is extended or adjusted under 35 U.S.C. 154(b) by 0 days.

(21) Appl. No.: 09/385,677

(22) Filed: Aug. 30, 1999

(51) Int. Cl.[7] ..... A44B 13/00; A44B 18/00
(52) U.S. Cl. ..... 24/306; 24/697.2
(58) Field of Search ..... 24/306, 442, 697.1, 24/697.2, 304, 682.1; 2/321; 450/79

(56) References Cited

U.S. PATENT DOCUMENTS 521,686 * 6/1894 Walter .
540,661 * 6/1895 Hardesty .
610,394 * 9/1898 Francis .
628,335 * 7/1899 Kleinschmidt et al. .
720,450 * 2/1903 Luellen et al. .
2,861,276 * 11/1958 Alfandre .
3,046,564 * 7/1962 Roseman et al. .
4,258,440 * 3/1981 McGowan .
4,300,568 * 11/1981 Blanckmeister .
4,879,766 * 11/1989 Hull et al. .
4,914,756 * 4/1990 Grassick .
4,917,651 * 4/1990 Rainville .
5,032,104 * 7/1991 Rainville .
5,111,807 * 5/1992 Spahn et al. .
5,624,296 * 4/1997 Weber-Unger .

* cited by examiner

*Primary Examiner*—James R. Brittain
(74) *Attorney, Agent, or Firm*—Swabey Ogilvy Renault; Guy Houle

(57) ABSTRACT

A closure for securement to an article of apparel and for use by a person having handicapped hands is described. The closure comprises a first fastener support member which has one or more fastener elements secured thereto. A second fastener support member is provided and has one or more fastener elements for interconnection with the fasteners of the first support member. The first and second fastener support members are adapted for securement to articles of apparel. The fasteners are removably interconnectable together with the support members overlapping. A first fabric loop is provided in a front face of one of the fastener support members and a second fabric loop is secured to a lower portion of the other fastener support member, and may depend therefrom or be concealed therebehind. The loops are of predetermined size and are disposed for engagement by a handicapped person for attaching and detaching the fasteners with one another with the support members overlapped with one another.

20 Claims, 4 Drawing Sheets

CLOSURE FOR ARTICLE OF APPAREL AND FOR USE BY A PERSON HAVING HANDICAPPED HANDS

TECHNICAL FIELD

The present invention relates to a closure for securement to an article of apparel, such as a brassiere, bathing suit top, girdle, skirt, etc. and for use by a person having limited use of their fingers.

BACKGROUND ART

In my U.S. Pat. No. 4,917,651 granted on Apr. 17, 1990 and U.S. Pat. No. 5,032,104 granted on Jul. 16, 1991, I disclose a brassiere for use by a handicapped person and which is attachable and detachable at the front central portion thereof between the cups. Opposed sides of the cups in this central portion are each provided with attaching portions and with these attaching portions having loops projecting substantially horizontally from the attaching portions. These loops are engaged by the fingers of the handicapped person to permit manipulation of the attaching portions. In U.S. Pat. No. 5,032,104 there are three loops in each attachment portion and accordingly the user person would thread three fingers of a hand through the three loops of one of the attaching portions and three fingers of the other hand in the three loops of the other attaching portion and then bring these attaching portions in overlapping juxtaposed relationship whereby to position the fastening hooks provided on the back face of one of the attachment portions into corresponding eyes secured on the outer surface of the front face of the back attaching portion. Usually, it would initially take several attempts for a user person to be able to engage these loops but after time this procedure becomes less difficult to the handicapped user person.

Although the brassieres as disclosed in my previous patents have found satisfactory utility on the marketplace, they still provide some inconveniences and disadvantages and particularly to persons who have serious limited use of their fingers. Also, certain persons with arthritis conditions may be affected more in one hand than the other hand and consequently may have extreme difficulty in manipulating at least one of the closure portions of the brassiere. I have also found that by providing all of these many loops makes it more difficult to use the brassiere and these affect the aesthetic appearance of the brassiere.

SUMMARY OF INVENTION

It is a feature of the present invention to provide a closure for securement to an article of apparel and for use by a person having limited use of her fingers and which substantially overcomes the above-mentioned disadvantages of the prior art.

Another feature of the present invention is to provide a closure for securement to an article of apparel for use by a person having limited use of her fingers and wherein the closure comprises a pair of fastener support members which utilize a single loop which is easily engageable by a person having handicapped hands.

Another feature of the present invention is to provide a closure for securement to an article of apparel for use by a person having limited use of her fingers and wherein such closure comprises two fastener support members which may be secured to the article of apparel for ease of engagement by the right hand or the left hand.

Another feature of the present invention is to provide a closure for securement to an article of apparel for use by a person having limited use of her fingers and wherein such closure member may be secured to a brassiere, a swimsuit top, a girdle, a skirt, and other articles of apparel for securing the article of apparel by a person having handicapped hands.

Another feature of the present invention is to provide a closure member for securement to an article of apparel for use by a person having limited use of her fingers and wherein the closure member comprises two fastener support members with one of these fastener support members having a loop secured in an outer wall in a top portion thereof and the other member having a depending loop which depends from a lower edge thereof for ease of grasping and securement by a single finger or finger portion of a person having handicapped hands and wherein the closure is easy to secure and unsecure.

According to the above features, from a broad aspect, the present invention provides a closure for securement to an article of apparel and for use by a person having limited use of her fingers. The closure comprises a first fastener support member having first fastener means secured thereto. A second fastener support member has a second fastener means secured thereto. The first and second fastener support members are adapted for securement to articles of apparel. The first and second fastener means are removably interconnectable with one another to retain the first and second fastener support members in overlapping relationship. A first fabric loop is provided in a front face of one of the fastener support members. A second fabric loop is secured to a lower portion of the other of the fastener support members. The loops are of predetermined size and disposed for engagement by handicapped hands for attaching and detaching the fastener means with one another with the said one of the fastener support members overlapped on top of the other of the fastener support member.

According to a further broad aspect of the present invention the closure may not be provided with loops if a person with handicapped hands is capable of engaging the first and second fastener means together. However, contact fastening means are secured adjacent the first and second fastener means for interconnecting attachment with one another when in pressure contact when the first and second fastener means are interconnected by handicapped hands capable of overlapping the fastener support member to interconnect the fastener means together. The contact fastener means are disposed in horizontal alignment with the first and second fastener means. The first fastener means is constituted by one or more rigid hook fastener members which are secured at predetermined locations on a rear face of the first fastener support member. The second fastener means is constituted by one or more rigid eye fastener members secured at predetermined locations to a front face of the second fastener support member and dimensioned to be engaged by associated ones of the one or more rigid hook fastener members.

In a preferred embodiment the fastener support members are incorporated in a brassiere.

BRIEF DESCRIPTION OF DRAWINGS

A preferred embodiment of the present invention will now be described with reference to the accompanying drawings in which.

DESCRIPTION OF PREFERRED EMBODIMENTS

Figure 3:
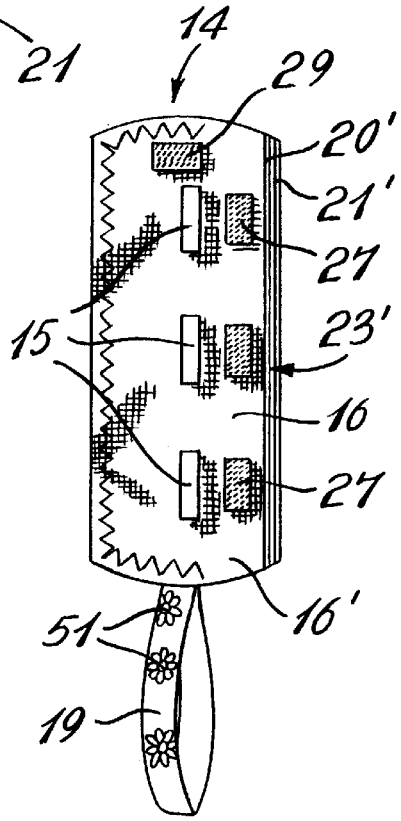
FIG. 3 is a front perspective view of a second fastener support member forming the closure of the present invention and showing the depending loop secured thereto.
Figure 4:
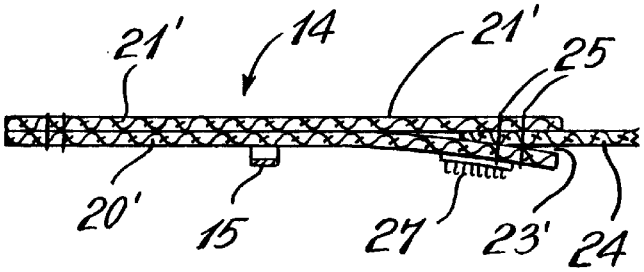
FIG. 4 is a top section view through the fastener support member of FIG. 3 and partly fragmented.
Figure 5:
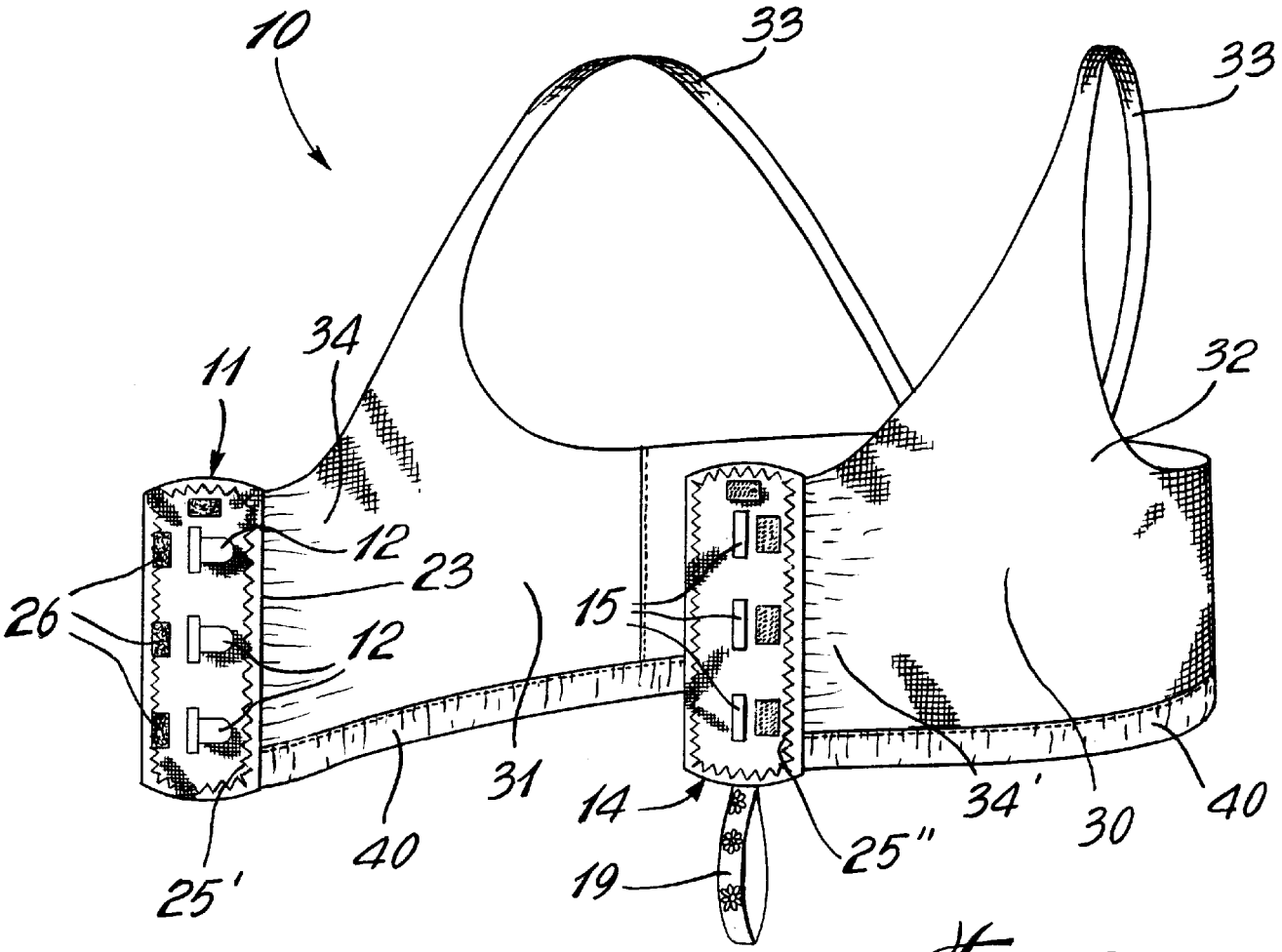
FIG. 5 is a perspective view of a brassiere to which the closure of the present invention has been secured.

Referring now to the drawings and more particularly to FIGS. 1 to 5, there will be described the construction and use of the closure of the present invention for securement to an article of apparel, such as the brassiere 10 as shown in FIG. 5 and for use by a person having limited use of her fingers such as a person suffering from arthritis or having any other hand handicap.

As shown in FIGS. 1 to 4, the closure of the present invention is comprised of a first fastener support member 11 which is provided with one or more rigid hook fasteners 12, herein three hook fasteners disposed equidistantly spaced apart on a rear face 13 of the first fastener support member 11. The closure also comprises a second fastener support member 14, as shown in FIGS. 3 and 4, and which is also provided with one or more rigid eye-type fasteners 15 equidistantly spaced apart and secured on a front face 16 thereof. The fastener support members 11 and 14 are hereinshown as elongated substantially rectangular flat reinforced fabric pieces, but could conceivably have a different shape. The hook fasteners 12 are adapted for hooking engagement with the eye fasteners 15, as will be described later. The eye fasteners 15 are preferably wider than the hook fasteners 12 to facilitate engagement.

Figure 1:
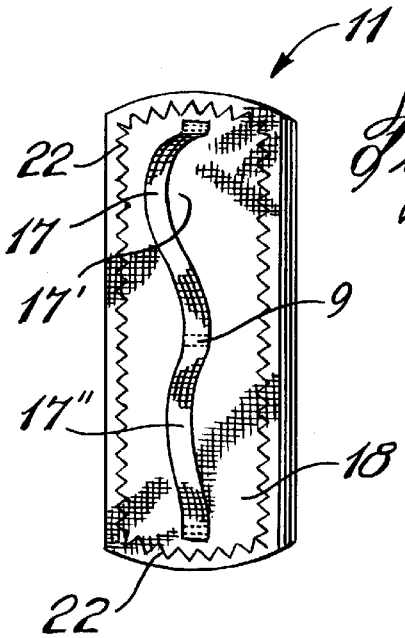
FIG. 1 is a front perspective view showing the construction of one of the fastener support members of the closure of the present invention and showing a loop secured in a top portion of the front face thereof.
Figure 2:
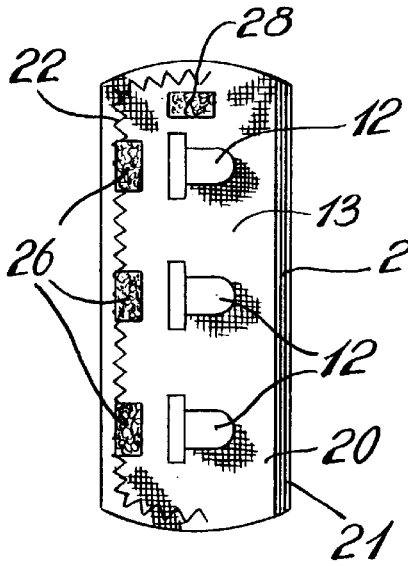
FIG. 2 is a rear perspective view of FIG. 1.

In order to facilitate the manipulation of the fastener support members 11 and 14 when secured to an article of apparel, a fabric loop 17 is secured in a top portion of the front face 18 of the first fastener support member 11 and projects outwardly of the front face 18 to form an opening 17' between the fabric loop 17 and the front surface 18. As shown in FIG. 1, the fabric forming the fabric loop 17 extends to the bottom of the front face 18 and stitched at 9 whereby to form a second loop band 17" but which does not have a pronounced protrusion from the front face 18. This second loop band 17" constitutes an auxiliary loop should it facilitate manipulation by the user person. It is, however, preferable to have a single loop 17.

Similarly, as shown in FIG. 3, the second fastener support member 14 is also provided with a single fabric loop 19 but which is secured and protrudes from a lower portion 16' of the front face 16 thereof. This loop 19 is also formed by a fabric band and these fabric bands have sufficient rigidity to maintain an open loop condition to facilitate engagement by the thumb or a finger of a person having handicapped hands.

As also shown in FIGS. 1 to 4, the fastener support members 11 and 14 are reinforced fabric pieces fabricated from two or three fabric layers, namely fabric layers 20, 21 and 20', 21'. . . . The layers are secured in juxtaposition by circumferential stitch line patterns 22 but these fastener support members may be left unstitched along a straight outer edge 23, 23' thereof whereby to secure same to fabric pieces 24 as shown in FIG. 4. As shown in FIG. 4, a fabric piece 24 is inserted between the unstitched edge 23' and then a further connecting stitch 25 is applied to secure the fastener support member 14 to an article of apparel containing the fabric 24.

It is pointed out that these articles of apparel use materials having elastic properties in the areas which are secured to these fastener support members 11 and 14 whereby to apply tension to retain the fasteners 12 and 15 engaged with one another. However, to provide added retention and peace of mind to the user that the fasteners will not become undone, there is further provided contact fastening members in the form of Velcro tabs 26 disposed adjacent each of the fasteners 12 and further Velcro tabs 27 disposed adjacent the eye fasteners 15. As hereinshown the fastener tabs 27 are constituted by hook tape pieces while the fastener tabs 26 are constituted by loop tape pieces, as is well known in the art. An additional tab 28 may be provided in a top portion of the rear face 13 of the fastener support member 11 and similarly a fastener tab 29 may be provided in the top portion of the front face 16 of the other fastener support member 14. When in use, the first fastener support member 11 is positioned over the second fastener support member in overlapped, substantially juxtaposed position and this is done as will be described later with reference to FIGS. 5 to 8.

As shown in FIG. 5, the closure of the present invention is herein shown incorporated in a brassiere and provides a front closure. The brassiere 10 has a pair of cup portions 30 and 31 which are interconnected and formed integral with a back panel 32. Shoulder straps 33 also interconnect the cup portions to the back panel as is well known in the art and as described and illustrated in my aforementioned U.S. Patents. As hereinshown the first fastener support member 11 is connected along its straight connecting edge 23 to a central connecting portion 34 of the cup portion 31 by connecting stitch line 25'. Similarly, the second fastener support member 14 is connected to the central connecting portion 34' of the other cup 30 by connecting stitch line 25". The fastener support member 14 is connected thereto with its eye fasteners 15 disposed outwardly. The first fastener support member 11 is connected with its hook fasteners 12 disposed inwardly.

Figure 6:
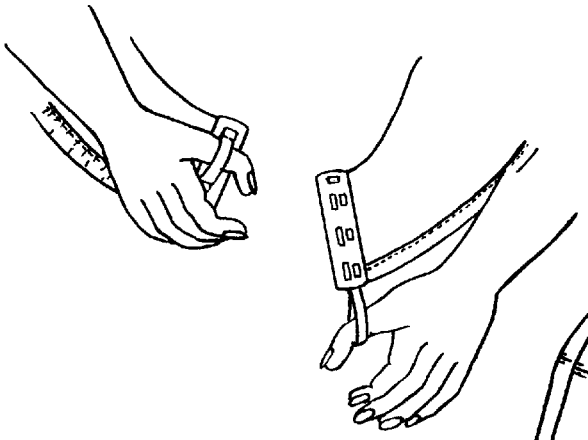
FIG. 6 is a fragmented perspective view showing how a person having handicapped hands secures the fastener support members of a brassiere whereby to connect and disconnect these members to one another.
Figure 7:
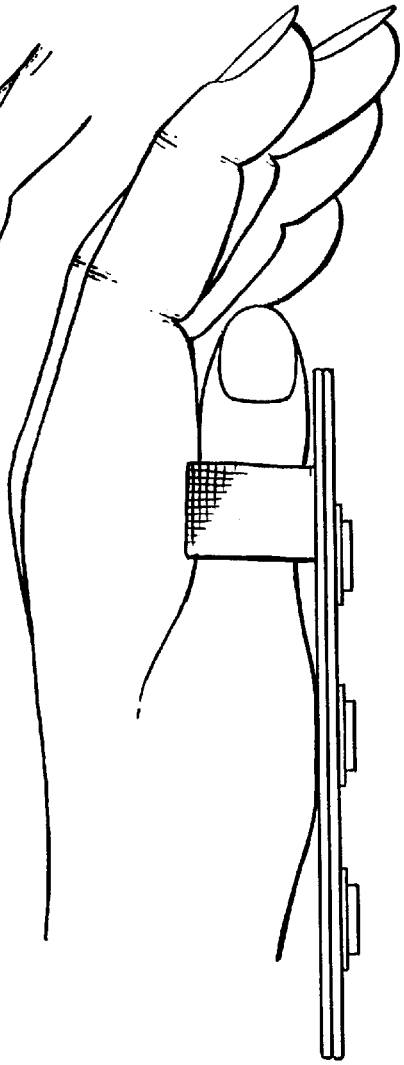
FIG. 7 is an enlarged view illustrating how the fasteners are interconnected to secure the support members together.
Figure 8:
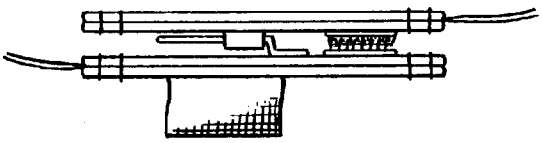
FIG. 8 is a top view illustrating the two fastener support members interconnected.
Figure 8:
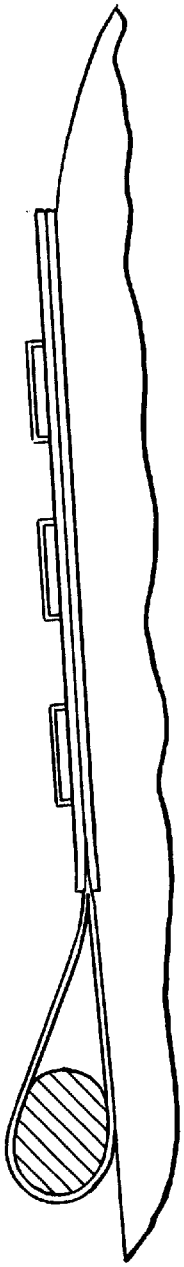

With reference now to FIGS. 6 to 8, there will be described the manner in which the fastener support members 11 and 14 are interconnected together. As shown in FIG. 6, the person with the handicapped hands positions the brassiere about his shoulders with the frontal central portion opened and facing forwardly. In this illustration, the fastener support member 14 is secured adjacent the left cup 30 while the other fastener support member 11 is secured adjacent the right cup 31, but these could be inverted to suit the user. The person engages the thumb 36 or a finger of his left hand 37 into the loop 19 and positions the cup 30 in position against the body 37, as shown in FIG. 7 and maintains it against the body by the palm or hand pressure. With the thumb 38 of the right hand 39, as shown in FIG. 7, the person then engages the loop 17 and brings the fastener support member 11 over and beyond the support member 14 with the fabric stretched.

Because the brassiere is provided with an elastic band 40 thereabout and made in part with stretchable fabrics, as shown in FIG. 5, there is applied a restoring force or a tensile force tending to pull the fastener support members away from one another. With the hook fasteners 12 in substantial alignment with the eye fasteners 15, this restoring force will guide the hook fasteners to engage within the eye fasteners 15, as shown in FIG. 8, when the user retracts his crossed hand 39 slightly from a position where the hands are criss-crossed one above the other. After the person senses that the hook fasteners are engaged within the eye fasteners, the person then applies pressure with the palm portion 41 of his right hand 39 or the wrist to engage the Velcro tabs 26, 27, 28 and 29 together. The user then withdraws the thumbs or fingers from engagement with the fastener support members.

To disconnect the fastener support members from one another, the user again engages the loops 17 and 19 in the same manner as he did for engaging the fastener support members together and pushes the fastener support members in opposed directions with the hands criss-crossing one above the other.

FIG. 8 is a simplified top section view showing the fastener support members 11 and 14 secured to an elastic waistband 50 of a skirt which circumscribes a user's waist. The fastener support members are connected in a like fashion as described above when secured to a brassiere but the loops 17 and 36 may be provided with decorative designs 51 on its outer faces, as shown in FIG. 3, for aesthetic appearance. These designs may match the color of the piece of apparel or have neutral designs adaptable to many different type of apparel sufficient only to say that the reason therefor is to conceal the use of these loops and to give them an appearance of design. Conceivably the brassiere 10 as shown in FIG. 5 may be constructed as a bathing suit top and again the loops would be provided with decorative designs or attachments. The depending loop 19 could also serve as a means to attach a key set or a article carrying capsule which is fashionable with swimwear.

Figure 9A:
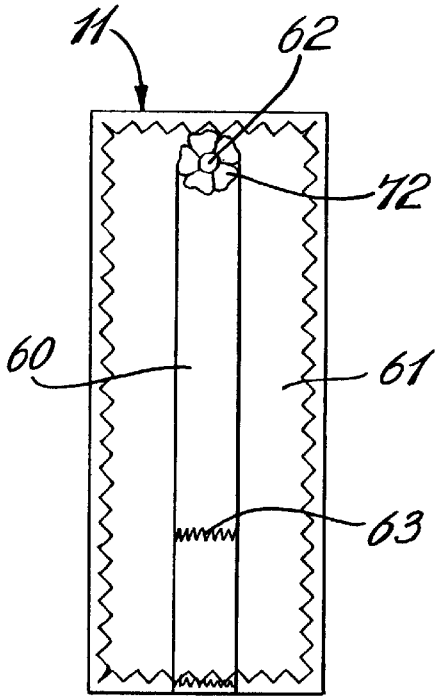
FIGS. 9A and 9B are front and rear views respectively illustrating another embodiment of a front one of the fastener support members.
Figure 9B:
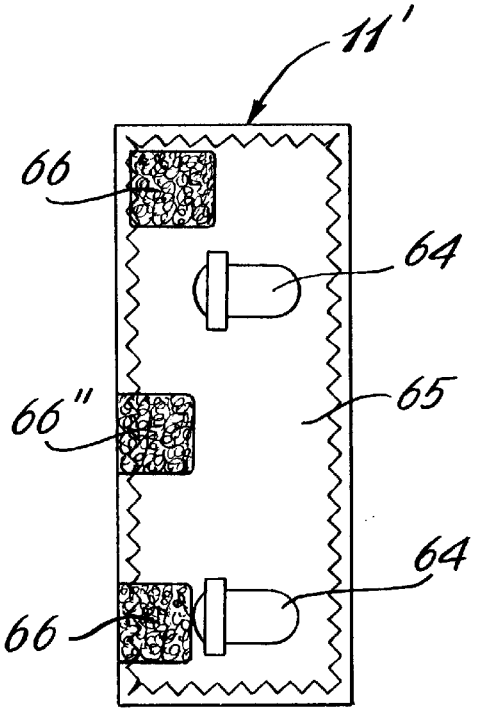

Referring now to FIGS. 9A and 9B, there is shown a further embodiment of the construction of the fastener support member 11'. As hereinshown, that member is provided with a fabric loop 60 which lies substantially flat over the outer face 61 of the member 11' and which forms a single loop between its fastened top portion 62 and the stitch line 63. This fabric loop 60 is constituted by a "Grosgrain" ribbon. By inserting the thumb or a finger between the ribbon or the fabric loop 60 and the outer face 61 of the fastener support member 11', in the manner illustrated in FIG. 6, a loop is formed between the ribbon 60 and the outer face 61.

As shown in FIG. 9B, this fastener support member 11' is provided with only two rigid hook fasteners 64 secured in a spaced apart manner on the rear face 65 of the fastener support member 11'. Fabric-type Velcro fastener tabs 66 are also appropriately secured to the rear face 65 and disposed for complimentary engagement by loop-type Velcro tabs 66' which are provided on the front face 67 of the second fastener support member 14', as illustrated in FIGS. 10A and 10B.

Figure 10A:
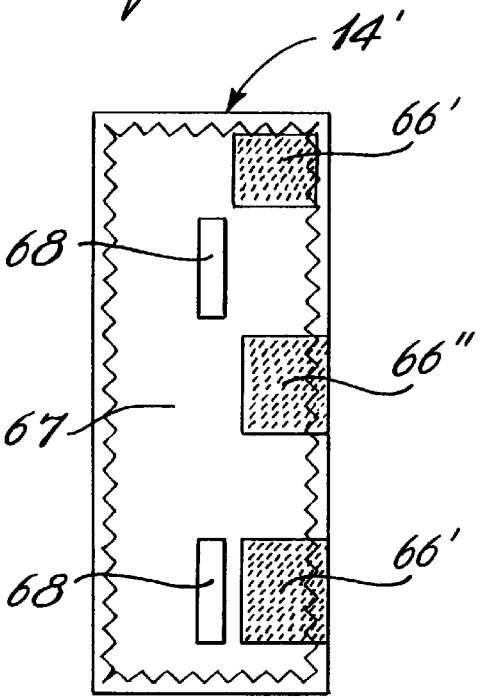
FIGS. 10A and 10B are front and rear views respectively of a rear one of the fastener support members for use with the support member of FIGS. 9A and 9B.
Figure 10B:
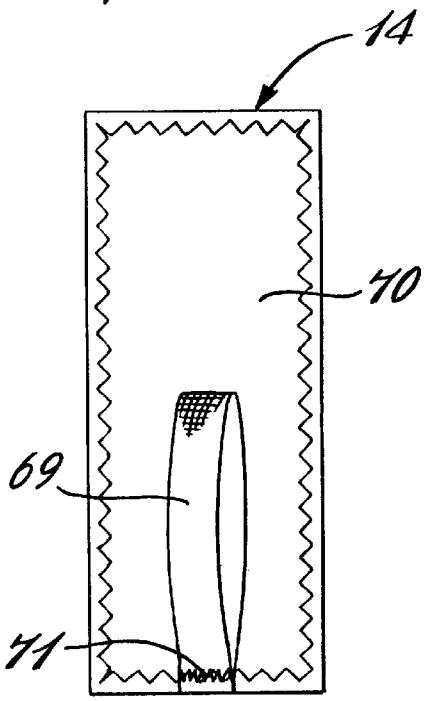

As shown in FIGS. 10A and 10B, the second fastener support member 14', herein the backing member, is provided with two rigid eye-type fasteners 68 appropriately secured to the rear face 67 for engagement by the rigid hook fastener 64. In this particular embodiment it can be seen that the second fabric loop is constituted differently than with the previous embodiments in that the loop 69 extends upwardly over the rear face 70 of the fastener support member 14'. The loop is secured to the lower edge of the fastener support member 14' by a securement stitch 71. The second loop 69 is also formed of the ribbon as above-identified and accordingly when the article of apparel, herein a brassiere such as that shown in FIG. 5, is worn by a user the loop 69 will not be visible and will rest comfortably inside the brassiere behind the rear fastener support member 14'.

As shown in FIG. 9A, a decorative piece such as a fabric rosette 72 may be integrated within the top stitching 62 and therefore compliments the design or aesthetic appearance of the front face of the fastener support member 11'. Also, because the fabric loop 60 is more subtle in appearance, this allows the lady who wears the brassiere, to use a tight-fitting sweater or blouse without any loops showing through, which would reveal the fact that the person is handicapped. The back loop 69 is only pulled down when it is needed and thereafter can be tucked away back to its hidden position where it will tend to restore itself to that position as shown in FIG. 10B seeing that it is a close-folded loop and has sufficient rigidity to maintain its shape while exhibiting a smooth surface which will not aggravate when positioned against the skin. As also shown in the embodiments of FIGS. 9A to 10B, only two hook-and-eyelet fasteners are used for securing the fastener support members 11' and 14' together and a further Velcro piece 66" and is disposed centrally therebetween. This stops the brassiere from opening at the center of its fasteners.

It is pointed out that the fastener support member as shown in FIG. 3 may be modified by removing the fabric loop 19 depending from its lower end if the person with handicapped hands is capable of effectuating the closure without the use of that loop. Additionally, the loops 17, 17' and 17" on the front face of the support member 11 could also be removed for that same purpose. Therefore, the invention envisages these fastener support members being provided without loops depending on its intended use but an important aspect of the fastener support members is the provision of the Velcro tabs 26 and 27 being disposed in horizontal alignment with the rigid hook fastener 12 and the rigid eye-type fasteners 15. The interconnection of the Velcro fasteners 26 and 27 would maintain the fastener members 12 and 15 interengaged together. The user person with its handicapped hands would merely apply pressure on the outer fastener support member 11 once the fasteners are engaged to ensure that the Velcro tab fasteners are securely interconnected.

It is within the ambit of the present invention to cover any obvious modifications of the preferred embodiment described herein, provided such modifications fall within the scope of the appended claims.

What is claimed is:

1. A closure for securement to an article of apparel and for use by a person having limited use of her fingers, said closure comprising a first fastener support member having first fastener means secured thereto, a second fastener support member having second fastener means secured thereto, said first and second fastener support members being adapted for securement to articles of apparel, said first and second fastener means being removably interconnectable with one another to retain said first and second fastener support members in overlapping relationship, a first fabric loop provided in a front face of one of said fastener support members, and a second fabric loop secured to a lower portion of the other of said fastener support members so as to extend downwardly away from said one of said fastener support members and so that in the engaged condition the support members are positioned with said one of said fastener support members overlapped on top of said other of said fastener support members with said second fabric loop uncovered and exposed for manual engagaement, said loops being of predetermined size and disposed for engagement by handicapped hands for attaching and detaching said fastener means with one another.

2. A closure as claimed in claim 1 wherein said second fabric loop secured to said lower portion of the other of said fastener support member is secured in a manner to be maintained depending from said lower portion.

3. A closure as claimed in claim 1 wherein said second fabric loop is secured to said lower portion of the other of said fastener support members in a manner to be maintained extending upwardly from said lower portion over a back face of said other of said fastener support members.

4. A closure as claimed in claim 1 wherein said first and second fabric loops are substantially flat loops which are caused to open and expand by said engagement by handicapped hands.

5. A closure as claimed in claim 1 wherein there is further provided contact fastening means secured adjacent said first and second fastener means for interconnecting attachment with one another when in pressure contact when said first and second fastener means are interconnected.

6. A closure as claimed in claim 5 wherein said first and second support members are reinforced fabric pieces.

7. A closure as claimed in claim 6 wherein said reinforced fabric pieces are secured to articles of apparel by stitch line formations.

8. A closure as claimed in claim 6 wherein said first fastener means is provided by one or more rigid hook fastener members secured at predetermined locations on a rear face of said first fastener support member.

9. A closure as claimed in claim 8 wherein said second fastener means is provided by one or more rigid eye fastener members secured at predetermined locations to a front face of said second fastener support member and dimensioned to be engaged by associated ones of said one or more rigid hook fastener members.

10. A closure as claimed in claim 9 wherein three of said rigid hook and eye fastener members are secured in a predetermined spaced relationship for interengagement.

11. A closure as claimed in claim 6 wherein an auxiliary fabric loop is secured to said front face of said one of said fastener support members and disposed below said first fabric loop.

12. A closure as claimed in claim 6 wherein said first and second fabric loops are formed of fabric bands having sufficient rigidity to maintain said loops in an open condition to permit ease of engagement thereof by the hands of a person having limited use of her fingers.

13. A closure as claimed in claim 6 wherein said contact fastening means is constituted by fastening tabs, said fastening tabs on one of said fastener support means being comprised by hook tape pieces, and said fastening tabs on the other of said fastener support means being comprised by loop tape pieces.

14. A closure as claimed in claim 5 wherein there is further provided an additional fastening tab secured adjacent a top end of said first fastener support member on a rear face thereof and disposed for mating engagement with an additional fastening tab secured adjacent a top end of a front face of said second fastener support member.

15. A closure as claimed in claim 5 wherein said first and second fastener support members each have an outer longitudinal straight edge and an opposed longitudinal fastening edge portion, said contact fastening means of said first fastener support member being disposed between said outer longitudinal straight edge and said first fastener means, said contact fastening means of said second fastener support member being disposed between said longitudinal fastening edge portion and said second fastener means.

16. A closure as claimed in claim 15 wherein said first and second fastener support members are elongated substantially rectangular flat reinforced fabric pieces.

17. A closure as claimed in claim 15 wherein said first and second fastener support members are reinforced fabric pieces comprised by at least a two-layer fabric, said fastener support members being unconnected along at least a portion of said opposed longitudinal fastening edge portion for attachment to fabric pieces disposed between said two-layer fabric and stitched thereto.

18. A closure as claimed in claim 1 wherein said article of apparel is a brassiere, said brassiere having a pair of cup portions interconnected by a back panel and shoulder straps, said first and second fastener support members being connected to a respective one of said cup portions for interconnection at a front central portion of said brassiere.

19. A closure as claimed in claim 1 wherein said article of apparel is one of a brassiere, a bathing suit top, a skirt or a girdle.

20. A closure as claimed in claim 1 wherein said article of apparel is a skirt apparel piece, said first and second fastener support members being secured to opposed end portions of a waistband of said skirt.

* * * * *